US009540077B2

(12) United States Patent
Fuller, IV et al.

(10) Patent No.: US 9,540,077 B2
(45) Date of Patent: Jan. 10, 2017

(54) CONCEALED LADDER

(71) Applicant: S2 Yachts Inc., Holland, MI (US)

(72) Inventors: Linwood Addison Fuller, IV, Vero Beach, FL (US); Dwayne Back, Cocoa, FL (US)

(73) Assignee: S2 Yachts Inc., Holland, MI (US)

( * ) Notice: Subject to any disclaimer, the term of this patent is extended or adjusted under 35 U.S.C. 154(b) by 0 days.

(21) Appl. No.: 14/624,122

(22) Filed: Feb. 17, 2015

(65) Prior Publication Data

US 2015/0232157 A1 Aug. 20, 2015

Related U.S. Application Data

(60) Provisional application No. 61/942,275, filed on Feb. 20, 2014.

(51) Int. Cl.

| | |
|---|---|
| ***E06C 5/00*** | (2006.01) |
| ***B63B 27/14*** | (2006.01) |
| ***E06C 1/38*** | (2006.01) |
| ***E06C 9/08*** | (2006.01) |
| *E06C 5/20* | (2006.01) |

(52) U.S. Cl.

CPC ..... *B63B 27/146* (2013.01); *E06C 1/38* (2013.01); *E06C 9/08* (2013.01); *E06C 5/20* (2013.01)

(58) Field of Classification Search

CPC ..... E06C 9/08; E06C 9/085; E06C 1/38; E06C 1/083; E06C 7/04; E06C 7/02; E06C 5/20; B63B 2027/141; B63B 27/146

USPC ..... 182/86, 88; 114/362, 364

See application file for complete search history.

(56) References Cited

U.S. PATENT DOCUMENTS

| | | | | |
|---|---|---|---|---|
| 6,789,648 | B2 * | 9/2004 | Cook | B63B 27/146 114/362 |
| 7,182,175 | B1 * | 2/2007 | Schmitt | B63B 27/143 114/362 |
| 8,689,939 | B2 * | 4/2014 | Kim | B60R 3/02 182/127 |

* cited by examiner

*Primary Examiner* — Andrew Polay
(74) *Attorney, Agent, or Firm* — Price Heneveld LLP

(57) ABSTRACT

A ladder assembly for mounting a concealed ladder to a boat includes a frame having a pair of spaced-apart guides. The frame is adapted to be mounted within a boat. A slide is movably mounted to the guides for sliding from one end of said frame to an opposite end, and a ladder is pivotally mounted to said slide, such that the ladder can extend from a hatch in the boat and be lowered for use of the ladder in entering and exiting the water from the boat. In one embodiment, a pivot plate is pivotally mounted to the slide and the ladder is pivotally mounted to the slide. A control arm is pivotally mounted to the pivot plate or slide and provides leverage for the easy deployment and storing of the ladder.

16 Claims, 5 Drawing Sheets

CONCEALED LADDER

CROSS-REFERENCE TO RELATED APPLICATIONS

This application claims priority under 35 U.S.C. §119(e) and the benefit of U.S. Provisional Application No. 61/942,275 entitled Concealed Ladder, filed on Feb. 20, 2014, by Dwayne Back et al., the entire disclosure of which is incorporated herein by reference.

BACKGROUND OF THE INVENTION

The present invention relates to a concealed ladder employed for a recreational vehicle, such as a boat, for ingress and egress to and from the water and particularly to a boat ladder which is stored in the bow area of a boat.

Typically, boats include a swim platform at the stern area which includes a folding, collapsible or some otherwise deployable swim ladder allowing boaters to anchor their boats and enjoy the surrounding water for swimming or engaging in water sports. Many boats, particularly small boats, do not have swim platforms and utilize collapsible ladders or even rope-type ladders attached to the sides or stern of the vessel for ingress and egress into and out of the water. While such ladders are useful, they may be cumbersome to use and must be safely stored when not in use so as not to interfere with the movement of the boat or take up valuable storage area on the vessel.

It would be desirable, therefore, to have an improved ladder system for boats that can be easily stowed and deployed by the boat occupants without interfering with usable space on the boat.

SUMMARY OF THE INVENTION

A ladder for concealably mounting to the bow area of a boat comprises a ladder assembly including a frame having a pair of spaced-apart guides. The frame is adapted to be mounted under the deck of a boat in the bow area. A slide is movably mounted to the guides for sliding from one end of said frame to an opposite end, and a ladder is pivotally mounted to said slide, such that the ladder can extend from a hatch in the side of the boat near the bow and be lowered for use of the ladder in entering and exiting the water from the boat. In one embodiment, the ladder is pivotally attached to a pivot plate, in turn, pivotally mounted to the slide allowing the ladder to rotate to a position parallel to the side of the boat once deployed. With such a system, a ladder can be concealably stored under the deck of a boat. In a preferred embodiment, the ladder is mounted in the bow area of a vessel and accessed for use through the anchor locker hatch. A control arm is pivotally mounted to the slide or pivot plate and provides leverage for the easy deployment and storing of the ladder.

These and other features, objects and advantages of the present invention will become apparent upon reading the following description thereof together with reference to the accompanying drawings.

DETAILED DESCRIPTION OF THE PREFERRED EMBODIMENT

Figure 1:
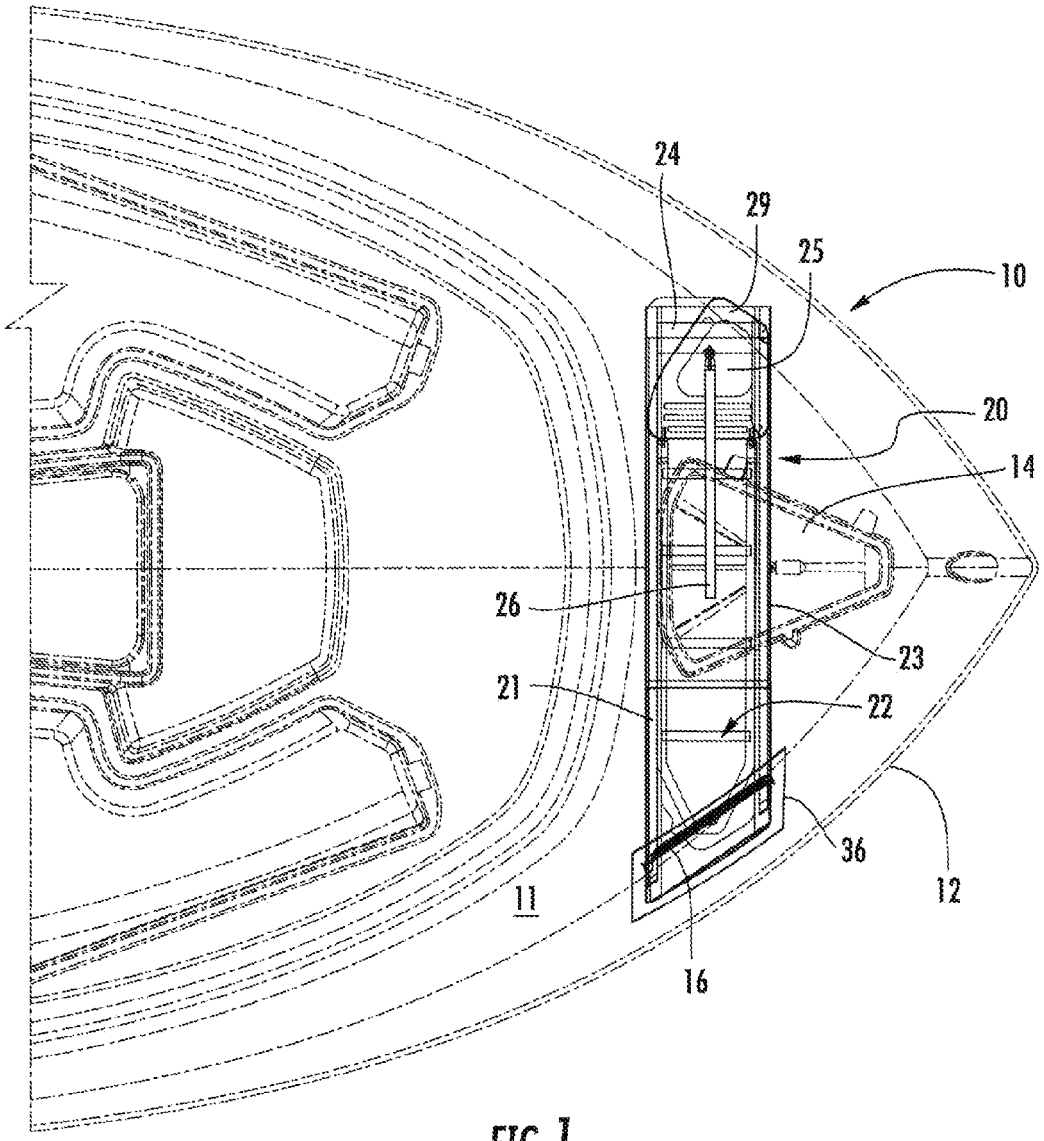
FIG. 1 is a fragmentary top plan view of a boat, showing the boat in phantom form and the bow ladder of the present invention in the stowed position.
Figure 2:
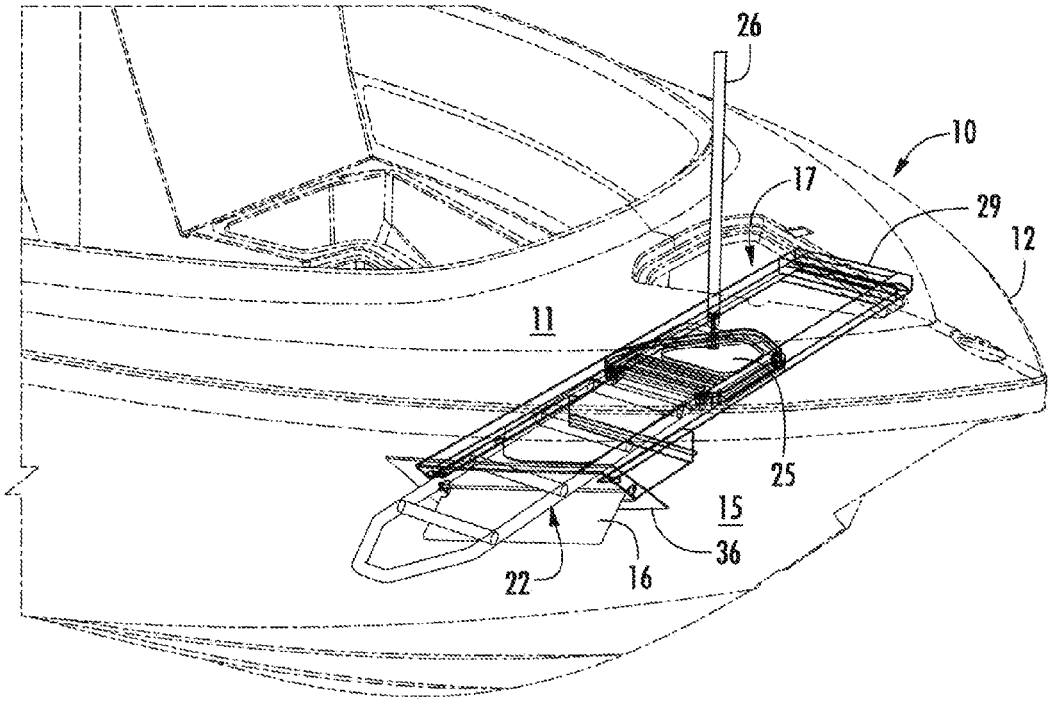
FIG. 2 is a fragmentary perspective view of the boat, showing the bow ladder of the present invention partially deployed through a hatch in the side of the boat located on the starboard bow of the boat.
Figure 3:
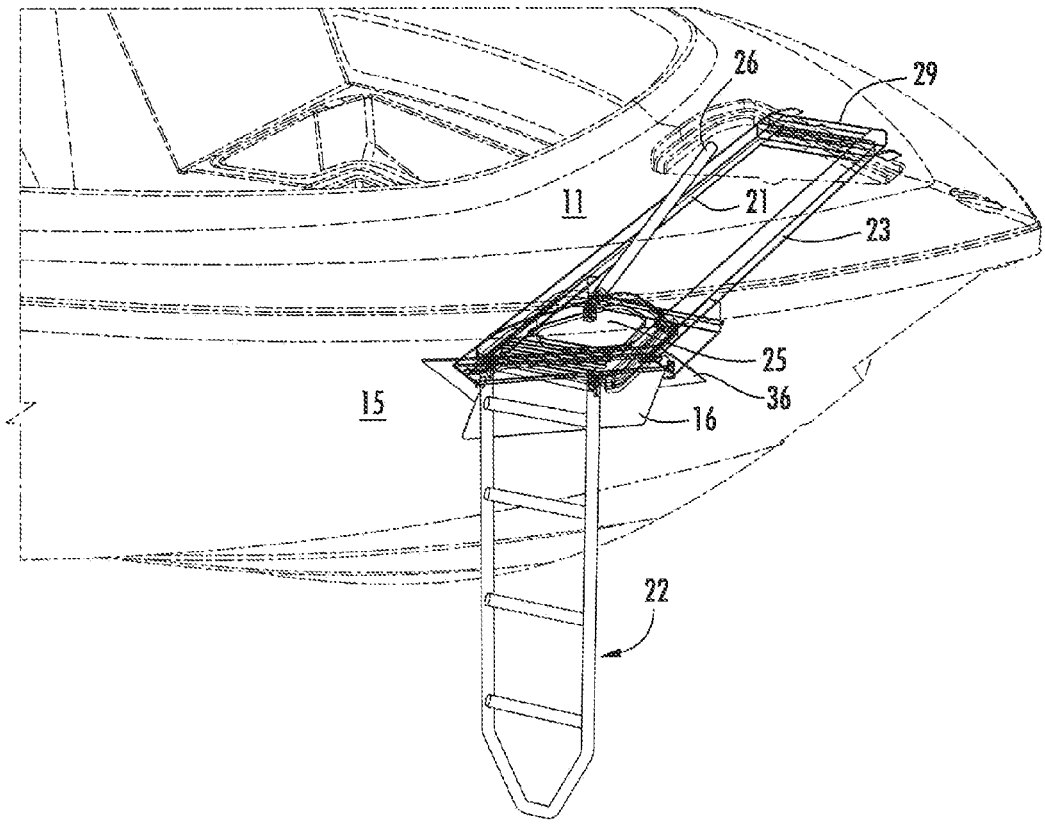
FIG. 3 is a fragmentary perspective view of the boat, showing the bow ladder of the present invention in a position further deployed.
Figure 4:
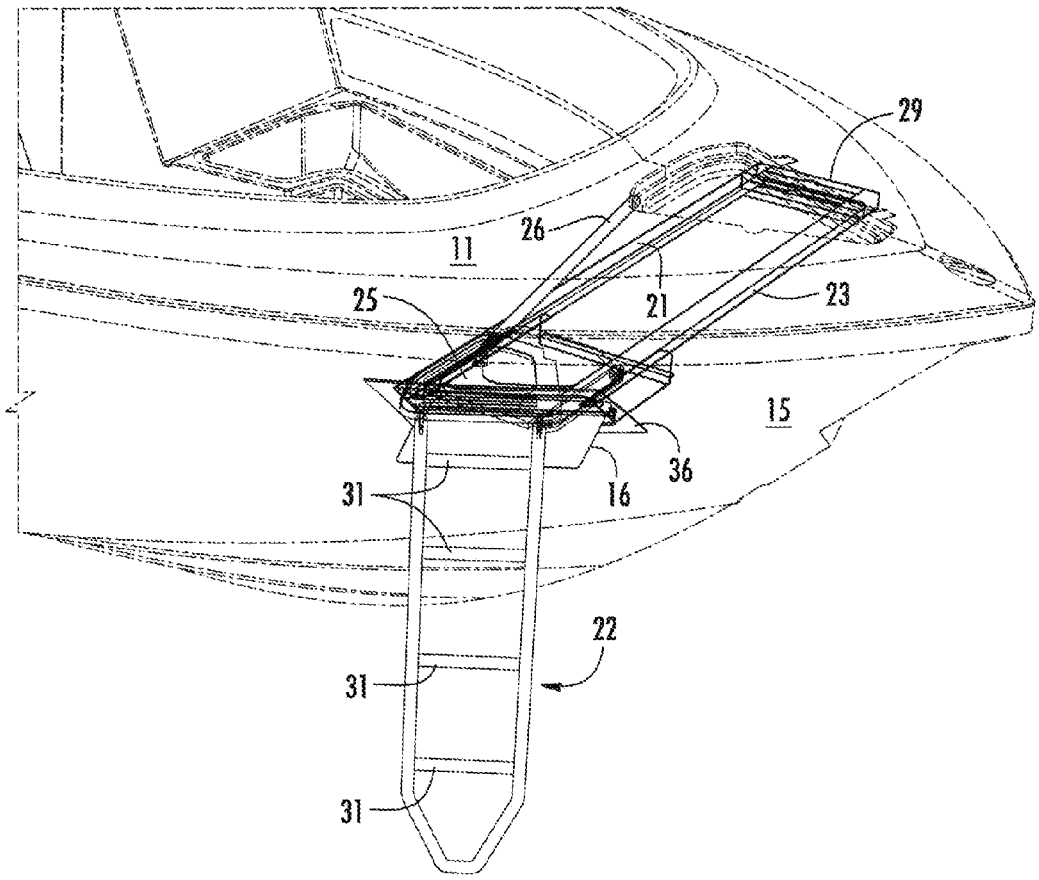
FIG. 4 is a fragmentary perspective view of the boat, showing the bow ladder in a fully deployed aligned position.

Referring initially to FIGS. 1-4, there is shown a boat 10 having a bow 12 with an anchor locker hatch 14 for gaining access to an anchor and the bow ladder assembly 20 of the present invention. The ladder assembly 20 is shown in FIG. 1 in a stowed position extending athwartship (i.e., starboard to port) under the deck 11 of the boat 10 in the bow area. The ladder assembly 20 includes a ladder 22 which is extended through a hatch 16 in the starboard side 15 of the boat near the bow area, as illustrated in FIGS. 2-4. The hatch 16 is pivotally mounted to a rectangular frame 36 which is secured to the starboard side 15 (FIGS. 2-4) of the boat 10 using conventional fastening hardware. Thus, frame 36 supports the ladder 22 as it moves through the hatch 16 as well as pivotally mounts the latch to the boat, such that the ladder 22 can extend therethrough and pivot downwardly, as seen in FIGS. 3-4.

Once the ladder is partially deployed as illustrated in FIGS. 2-3, further movement of the slide to which the ladder is pivotally mounted via a pivot plate is rotated, as seen in FIG. 4, to a position parallel with the starboard side 15 of the boat 10. This allows individuals using the ladder 22 of ladder assembly 20 to more easily climb aboard the boat or climb down into the water. For such purpose, a grab handle (not shown) may be mounted on the deck 11 of the boat in the bow area near the hatch 16 to assist the user.

Figure 5:
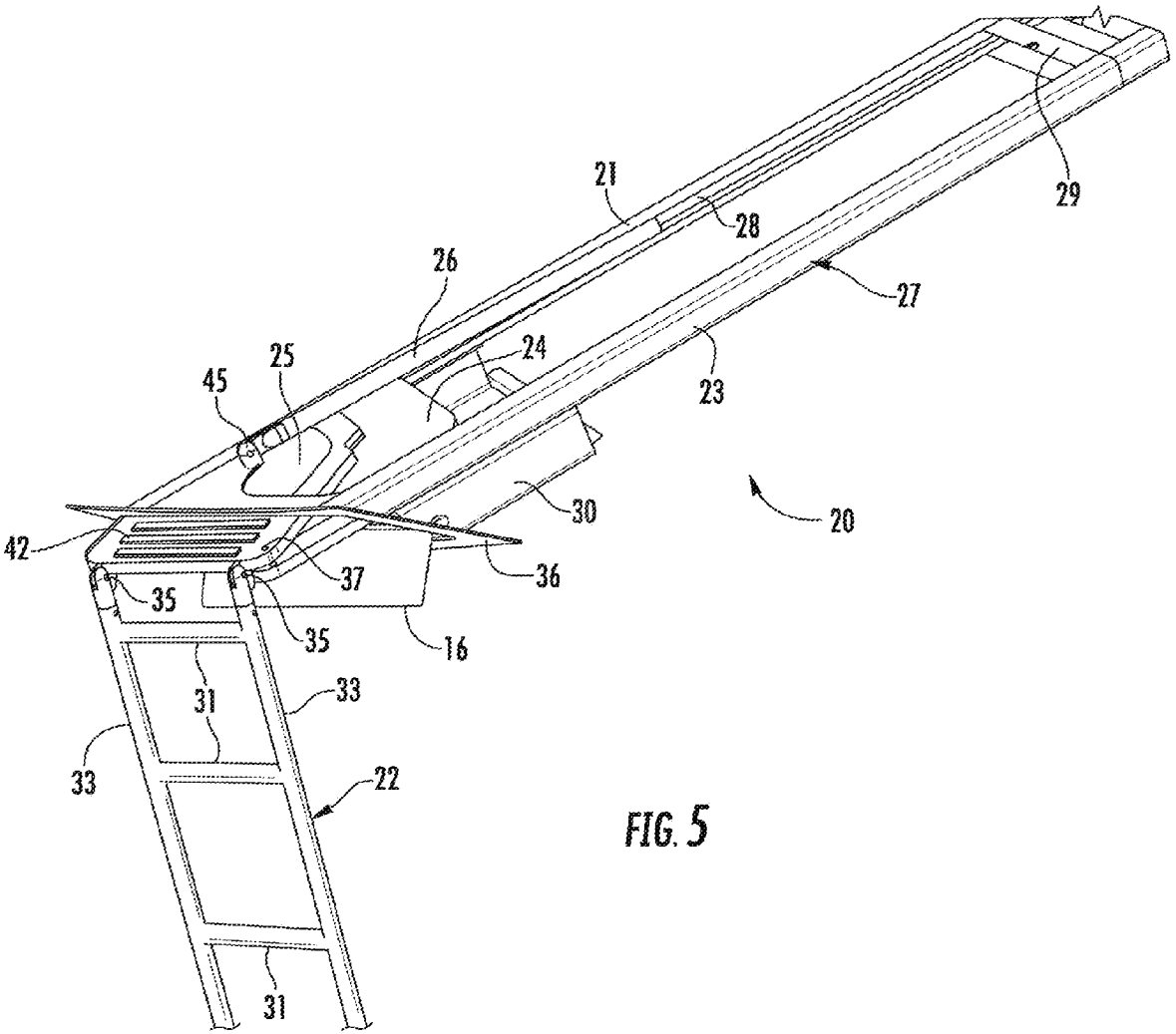
FIG. 5 is a perspective view showing the ladder assembly itself with the ladder in a fully deployed position by using a control arm engaging the pivot plate of the ladder assembly.

The ladder assembly 20 includes, as best seen in FIG. 5, a frame 27 having parallel spaced-apart guides 21 and 23, each with guide tracks 28, for slideably supporting a slide 24 and a pivot plate 25. Guide 21 is secured to the bulkhead of anchor locker 17 using conventional marine grade fasteners to hold the frame 27 in position below the deck 11 of the boat 10. Frame 27 includes cross supports 29 and 30 at opposite ends of the guides 21, 23. In the preferred embodiment, frame 27 is positioned to extend within the anchor locker 17, such that, as seen in FIG. 1, access to the anchor (not shown) positioned in the anchor locker is provided between pairs of rungs 31 of ladder 22. The ladder and remaining components of the assembly 20 are made of stainless steel or polymeric material to withstand the marine environment.

Ladder 22 includes a pair of spaced-apart legs 33 supporting a plurality of rungs 31 therebetween. The upper ends of legs 33 are pivotally mounted by pivot pins 35 to a pivot plate 25, as best seen in FIG. 5. Plate 25 is pivotally mounted to slide 24 by pivot pin 37. Pivot plate 25 includes a textured step 42 on its upper surface to assist in using the ladder 22 when fully deployed, as seen in FIGS. 4 and 5. A control arm 26 is pivotally mounted to the pivot plate 25 by pivot connection 45, as best seen in FIG. 5. Arm 26 is accessed through the open hatch 14 of the anchor locker to deploy the ladder, as shown in the sequence of views in FIGS. 1-4.

In FIG. 1, the control arm 26 is shown in a nested position secured to the frame 27 by a suitable latch (not shown)

which secures the ladder 22 in a stowed position when not in use and when the boat 10 is underway. When it is desired to deploy the ladder, the anchor hatch 14 is opened to expose the control arm, as seen in FIG. 1. The arm 26 is raised, as illustrated in FIG. 2, by its pivot connection 45 to pivot plate 25. As the operator urges the ladder 22 outwardly through the hatch 16 on the starboard side of the boat, the ladder extends from the frame 27, as illustrated in FIGS. 2 and 3. The vertically extending legs 33 of ladder 22 are pivotally mounted by pivot pins 35 (FIG. 5) to the end of pivot plate 25, such that, once the ladder clears the guides 21 and 23, it drops downwardly, as illustrated in FIGS. 4 and 5, with its lower end toward the water. In order to orient the ladder 22 parallel to the starboard side 15 of the vessel, as illustrated in FIGS. 4 and 5, pivot plate 25 is rotated in a counterclockwise direction to orient the ladder parallel to the starboard side 15 of the boat. The control arm 26, which is largely under the deck 11, is returned downwardly into a locking position on frame 27 to lock the ladder in a lowered use position.

When the ladder assembly 20 (FIG. 2) is mounted in the bow, the control arm 26 is readily accessible through the anchor locker hatch 14 and is raised from the hatch, pivoted toward the port side of the vessel, and pushed toward the starboard side to deploy the ladder 22, as illustrated in FIGS. 1-4. To stow the ladder 22, the operator pulls on control arm 26, which engages hatch 16 to tilt the ladder upwardly, as seen in FIGS. 3 and 2. The ladder can then be fully retracted and locked in place. As the ladder 22 is moved to its stowed position, it engages an edge of the pivoted hatch 16 inboard of its pivot connection to frame 36 to pivot the hatch to a closed position. Since the anchor locker 17 is sealed from the rest of the boat and has its own drain, the hatch 16 need not form a watertight seal with frame 36. The latching mechanism for locking the ladder 22 in stowed and use positions can be a locking pin secured to a ladder leg 33 and include a spring-loaded ball for engaging apertures appropriately located on guides 21 and/or 23.

The ladder assembly, including the frame, control arm, and ladder itself, will all be manufactured of a suitable material, such as stainless steel, with stainless steel hinges and pivot mechanism. Guides 21 and 23 may have elongated slots and include polymeric inserts in a U-shaped configuration for receiving edges of slide 24 and pivot plate 25 to facilitate the movement of the ladder between stowed and extended use positions.

Thus, with the system of the present invention, a ladder is concealably and conveniently stowed in the bow or other area of a vessel and is securely locked and stowed in stowed and use positions by the interaction between the control arm and the frame for the ladder assembly.

It will become apparent to those skilled in the art that various modifications to the preferred embodiment of the invention as described herein can be made without departing from the spirit or scope of the invention as defined by the appended claims.

The invention claimed is:

1. A ladder for mounting to the bow of a boat comprising:

a ladder assembly including a frame having a pair of spaced-apart guides, said frame adapted to be mounted under the deck of a boat;

a slide movably mounted to said guides for sliding from one end of said frame to an opposite end;

a ladder pivotally mounted to said slide, such that said ladder can extend from the boat and be lowered for use of the ladder in entering and exiting the water from said boat;

a deck hatch in the deck of the boat for accessing said ladder; and a control arm pivotally mounted to said ladder and accessible through said deck hatch to allow an operator to manually raise said control arm above the deck and slide said ladder between deployed and stored positions using said control arm.

2. The ladder as defined in claim 1 wherein said frame is adapted to be mounted in the bow area of the boat.

3. The ladder as defined in claim 2 and further including a second hatch pivotally mounted to a side of the boat to allow said ladder to extend through said hatch.

4. The ladder as defined in claim 3 and further including a pivot plate extending between said ladder and said slide and pivotally mounted to said slide to allow said ladder to rotate on a generally vertical axis to align with a side of the boat when extended.

5. The ladder as defined in claim 4 wherein said control arm is pivotally mounted to said pivot plate for moving said slide and ladder between stowed and deployed positions.

6. A ladder for mounting to the bow of a boat comprising:

a ladder assembly including a frame having a pair of spaced-apart guides, said frame adapted to be mounted under the deck of a boat in the bow area;

a slide movably mounted to said guides for sliding from one end of said frame to an opposite end; and a ladder pivotally mounted to said slide, such that said ladder can extend from a hatch in the boat and be lowered for use of the ladder in entering and exiting the water from said boat, and including a hatch pivotally mounted to a side of the boat to allow said ladder to extend through said hatch, and further including a pivot plate extending between said ladder and said slide and pivotally mounted to said slide to allow said ladder to rotate on a generally vertical axis to align with a side of the boat when extended, and a control arm pivotally mounted to said pivot plate for moving said slide and ladder between stowed and deployed positions, and further including an anchor locker hatch which can be opened to gain access to said control arm.

7. A ladder assembly comprising:

a frame having a pair of spaced-apart guides;

a slide movably mounted to said guides for sliding from one end of said frame to an opposite end;

a pivot plate pivotally mounted to said slide;

a ladder pivotally mounted to said pivot plate, such that said ladder can extend from said frame for use; and a control arm pivotally mounted to said pivot plate to be raised above said slide to allow an operator to manually move said pivot plate, slide, and ladder between stowed and deployed positions.

8. The ladder assembly as defined in claim 7 wherein said frame is adapted to be mounted in the bow area of a boat.

9. The ladder assembly as defined in claim 8 and further including a hatch pivotally mounted to a side of the boat to allow said ladder to extend through said hatch.

10. The ladder assembly as defined in claim 9 wherein said pivot plate allows said ladder to rotate on a generally vertical axis to align with a side of the boat when extended.

11. A ladder assembly comprising:

a frame having a pair of spaced-apart guides, said frame is adapted to be mounted in the bow area of a boat;

a slide movably mounted to said guides for sliding from one end of said frame to an opposite end;

a pivot plate pivotally mounted to said slide; and a ladder pivotally mounted to said pivot plate, such that said ladder can extend from said frame for use and further including a control arm pivotally mounted to said pivot plate for moving said pivot plate, slide, and ladder between stowed and deployed positions, a hatch pivotally mounted to a side of the boat to allow said ladder to extend through said hatch, wherein said pivot plate allows said ladder to rotate on a generally vertical axis to align with a side of the boat when extended, and further including an anchor locker hatch which can be opened to gain access to said control arm.

12. A ladder for mounting to a boat comprising:

a ladder assembly including a frame having a pair of spaced-apart guides, said frame adapted to be mounted within a boat under a deck hatch;

a slide movably mounted to said guides for sliding from one end of said frame to an opposite end;

a ladder pivotally mounted to said slide, such that said ladder can extend from a side of the boat and be lowered for use of the ladder in entering and exiting the water from a side of said boat; and a control arm pivotally mounted to said ladder and accessible through said deck hatch to be raised above the deck of the boat for manually moving said ladder between stowed and deployed positions.

13. The ladder as defined in claim 12 and further including a pivot plate extending between said ladder and said slide to allow said ladder to rotate on a generally vertical axis to align with a side of the boat when extended.

14. The ladder as defined in claim 13 wherein said frame is adapted to be mounted in the bow area of the boat.

15. The ladder as defined in claim 14 and further including a hatch pivotally mounted to a side of the boat to allow said ladder to extend through said hatch.

16. A ladder for mounting to a boat comprising:

a ladder assembly including a frame having a pair of spaced-apart guides, said frame adapted to be mounted in the bow area of a boat;

a slide movably mounted to said guides for sliding from one end of said frame to an opposite end; and a ladder pivotally mounted to said slide, such that said ladder can extend from the boat and be lowered for use of the ladder in entering and exiting the water from said boat, a pivot plate extending between said ladder and said slide to allow said ladder to rotate on a generally vertical axis to align with a side of the boat when extended, a control arm pivotally mounted to one of said slide and pivot plate for moving said ladder between stowed and deployed positions, a hatch pivotally mounted to a side of the boat to allow said ladder to extend through said hatch, and further including an anchor locker hatch which can be opened to gain access to said control arm.

* * * * *